US006702487B2

(12) United States Patent
Kohno et al.

(10) Patent No.: US 6,702,487 B2
(45) Date of Patent: Mar. 9, 2004

(54) PHOTOGRAPHIC PROCESSOR FOR SILVER HALIDE PHOTOGRAPHIC MATERIAL AND REMOTE CONTROL SYSTEM FOR THE PROCESSOR

(75) Inventors: Junichi Kohno, Hachioji (JP); Hiroaki Kobayashi, Hachioji (JP)

(73) Assignee: Konica Corporation, Tokyo (JP)

( * ) Notice: Subject to any disclaimer, the term of this patent is extended or adjusted under 35 U.S.C. 154(b) by 49 days.

(21) Appl. No.: 10/107,376

(22) Filed: Mar. 26, 2002

(65) Prior Publication Data

US 2002/0141759 A1 Oct. 3, 2002

(30) Foreign Application Priority Data

Mar. 30, 2001 (JP) ..... 2001-100261

(51) Int. Cl.[7] ..... G03D 3/02

(52) U.S. Cl. ..... 396/578; 396/626; 430/400

(58) Field of Search ..... 396/564–636; 430/30, 399, 400; 355/27–29, 77; 134/64 P, 64 R, 122 P, 122 R; 702/122; 714/25

(56) References Cited

U.S. PATENT DOCUMENTS

| | | | | | |
|---|---|---|---|---|---|
| 5,291,420 | A | * | 3/1994 | Matsumoto et al. | 702/122 |
| 5,402,361 | A | * | 3/1995 | Peterson et al. | 382/167 |
| 5,552,851 | A | * | 9/1996 | Koboshi et al. | 396/626 |
| 5,669,031 | A | | 9/1997 | Ishikawa et al. | 396/569 |
| 5,708,903 | A | * | 1/1998 | Kashino et al. | 396/568 |
| 6,117,601 | A | * | 9/2000 | Kanazawa et al. | 430/30 |
| 6,222,607 | B1 | * | 4/2001 | Szajewski et al. | 396/578 |
| 2001/0007138 | A1 | * | 7/2001 | Iida et al. | 714/25 |

FOREIGN PATENT DOCUMENTS

JP 09000291 7/1998

* cited by examiner

*Primary Examiner*—D. Rutledge
(74) *Attorney, Agent, or Firm*—Squire, Sanders & Dempsey

(57) ABSTRACT

A photographic processor for a silver halide photographic material is disclosed, comprising a means for supplying a replenisher or water in accordance with processing amount information, wherein the processor further comprises a correction means for correcting the replenisher- or water-supplying rate on the basis of measurement data of a specific gravity or a pH of the processing solution. A remote control system of the processor is also disclosed, which is connected to a host computer through communication network.

18 Claims, 3 Drawing Sheets

PHOTOGRAPHIC PROCESSOR FOR SILVER HALIDE PHOTOGRAPHIC MATERIAL AND REMOTE CONTROL SYSTEM FOR THE PROCESSOR

FIELD OF THE INVENTION

The present invention relates to a photographic processor for processing silver halide photographic light sensitive materials and a remote control systems for control a processor for silver halide photographic materials, and in particular to a processor for silver halide photographic materials, in which corrections for processing solutions are made in accordance with information of the state of the processing solution and a remote control system of the processor.

BACKGROUND OF THE INVENTION

The desire for seeing picture-taken photographs as soon as possible or for getting finished photographs as promptly as possible after dropping off exposed photographic film to be processed have recently increased the number of minilabs. In response thereto, request for rapid access of silver halide photographic materials [hereinafter, also denoted as simply as photographic material(s)] has increased and photographic processing at relatively high temperature using automatic processors has become popular.

From the trend of global environmental protection, The London Agreement was concluded and ocean disposal of photographic processing effluents was prohibited in Japan from Jan. 1, 1996. In response thereto, efforts to reduce the processing effluent to the limit have been made in the photographic art. To lower the replenishing rate of a replenisher solution, for example, techniques for minimizing processing effluent amounts have come into practical use, including the use of a replenishing solution at a concentration as high as possible and the use of solid processing compositions.

However, processing at a relatively low replenishing rate results in carrying-out of the processing solution by the photographic material and concentration due to evaporation of the processing solution under high temperature as well as accumulation of ingredients leached out from photographic materials, produced problems, such as increased chemical activity of the processing solution rendering consistent desired processing performance infeasible, precipitation of coagulums due to concentration and deteriorated storage stability of the processing solution. Accordingly, to achieve stable processing performance, there are known controlling conditions of the processing solution, employing control parameters such as the temperature, pH, liquid-level position, ingredient concentration and specific gravity of the processing solution.

There is also known a technique for preventing concentration of a processing solution, in which water is replenished based on measurement of the specific gravity of the processing solution. An attempt to overcome such problems as delayed detection of the specific gravity causing excessive dilution at the time of adding replenishing water was disclosed in JP-A No. 1-158433 (hereinafter, the term, JP-A means an examined, published Japanese Patent Application), in which a processing solution is taken from a part of the circulation pass to determine the solution density by means of a liquid densitometer and water containing a preservative is supplied in accordance with the resultant output.

JP-A No. 1-281446 discloses an automatic processor provided with a means for supplying a replenishing solution, in which water is automatically replenished based on specific gravity information of the processing solution; JP-A No. 4-3058 discloses a technique, in which the density of the washing water or the stabilizing solution in the processing space connecting divided plural chambers are determined and supply of washing water or stabilizing solution is controlled based on the determined density values. Furthermore, JP-A No. 10-198006 discloses a technique, in which in accordance with variation in density of the developing and/or fixing tanks, water is replenished to the tanks.

The techniques taught in these disclosures, however, concern replenishing water corresponding to insufficient volume on the basis of an increased density, caused by concentration of the processing solution. As a result, it was proved to produce problems that in cases when excess water is replenished, for example, due to failure in the supply control of the water-supplying pump, it results in excessive dilution without correction thereof, or alternatively the extent of dilution is further magnified.

SUMMARY OF THE INVENTION

Accordingly, it is an object of the invention to provide a photographic processor for silver halide photographic materials, in which optimum correction is feasible and processability (such as fixing ability, desilvering ability, prevention of leuco dye formation and the like), even when the water replenishing amount is excessively increased due to failure of supply control of a liquid-supplying pump or when the water-evaporation is less than the assumed value, resulting in excessive dilution.

It is an object of the invention to provide a remote control system for controlling the foregoing processor.

The foregoing object of the invention is accomplished by the following constitution:

1. A photographic processor for processing a silver halide photographic material, comprising at least one processing tank containing a processing solution, a means for supplying a replenisher to the processing tank in proportion to the amount of the processed photographic material and a means for supplying water to the processing tank, wherein the processor further comprises a correction means for correcting a rate of supplying the replenisher or water to the processing tank based on measurement data of the specific gravity or the pH of the processing solution;
2. A remote control system for controlling a photographic processor for a silver halide photographic material, wherein the photographic processor is connected to a host computer through a communication means so that measurement data of a specific gravity or pH of a processing solution contained in at least one processing tank of the processor is transmitted to the host computer, the transmitted data is subjected to calculation to obtain a calculation result, the calculation result being transmitted to the photographic processor through the communication means to control supply of a replenisher or water to the processing tank; the remote control system comprising:
   - a means for measuring a specific gravity or a pH of the processing solution, and
   - a control means for controlling a supplying rate of the replenisher or water to the processing tank.

DETAILED DESCRIPTION OF THE INVENTION

Figure 1:
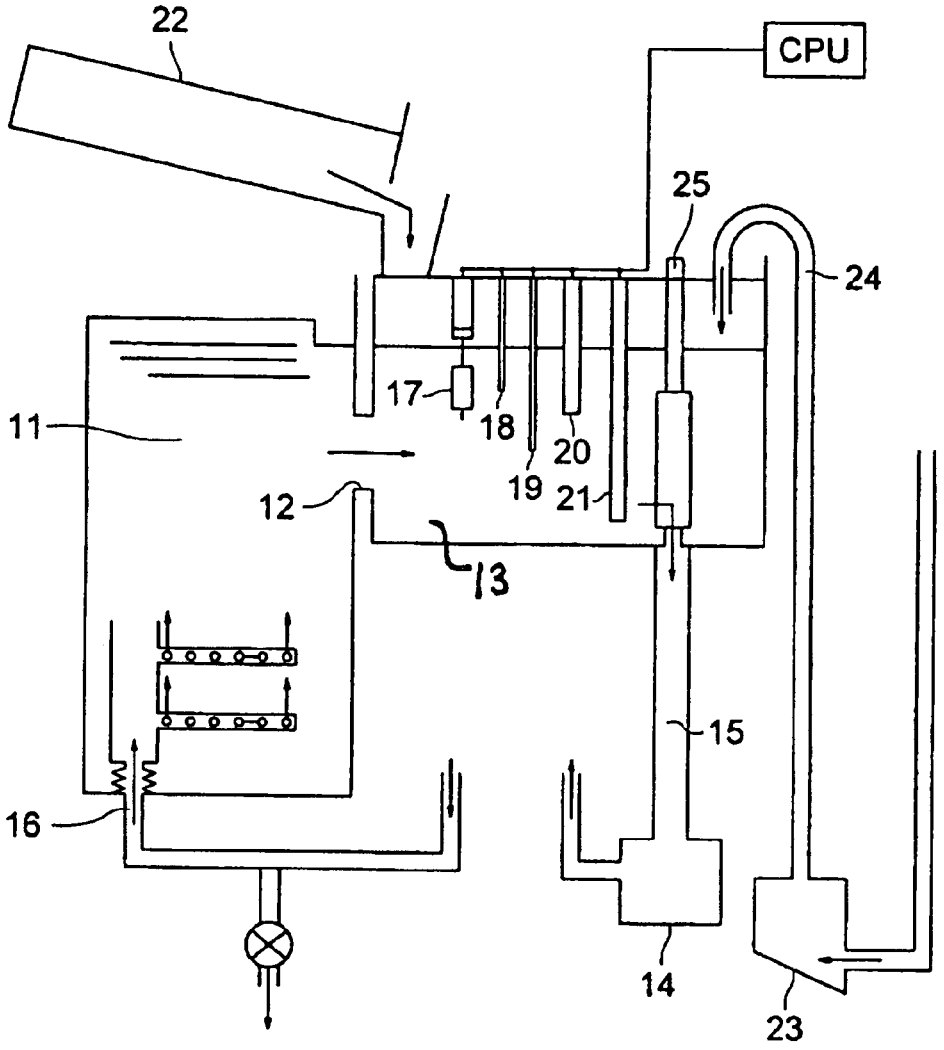
FIG. 1 illustrates an example of a processing tank relating to the invention.

In cases where the replenisher is a concentrated solution, the means for supplying a replenisher relating to the invention (hereinafter, also denoted as a replenisher supplying means) refers to various means capable of quantitatively transferring the solution, such as a pump; in cases where the replenisher is a solid processing composition such as granules or powder, the means for supplying a replenisher refers to various means capable of quantitatively transferring the solid processing composition such as granules or powder, including, for example a screw feeder or an extrusion type feeder; in cases where the replenisher is in the form of a solid processing composition such as tablets, the means for supplying a replenisher refers to means capable of quantitatively transferring such tablets, for example, replenishing apparatuses of a solid processing composition as described in JP-A Nos. 7-230153, 7-230155 and 8-101490. In any of the foregoing cases, the supplying operation is conducted in accordance with processing volume information (which is usually via electric signals). The processing volume information refers to information of the volume of photographic material processed in the processor. For example, the replenisher is supplied in proportion to the volume of the processed photographic material. In cases where the replenisher is a solid processing composition such as powder, granules or tablets, the replenisher supplying means preferably has a structure capable of preventing troubles in supply of the replenisher, caused by moisture.

In the invention, the means for supplying water (hereinafter, also denoted as a water supplying means) is a means for replenishing water, that is, a means for supplying water in proportion to the amount of the replenisher that is supplied in accordance with processing volume information, usually referring to a means for directly or indirectly supplying water to the processing tank by various kinds of pumps such as a bellows pump. Thus, it is a means for supplying the water necessary as a replenishing component other than the replenisher containing ingredients useful for photographic processing when photographic material is being continuously processed. In this respect, a means for replenishing water for the purpose of correction of reduced water content due to evaporation, regardless of the replenisher. In this case, the water replenishing means of the invention may replenish water in combination with correction for reduced water content due to evaporation.

Further, the water may be usual water having no component other than components inherently contained in tap water or well water and trace amounts of components dissolved in recycled water obtained by treating photographic processing effluents or may be overflowing solution from the step subsequent to the said processing tank.

There can be employed any specific gravity sensor that can output a specific gravity value as an analog/digital data and examples thereof include densimeter DA-110, available from KYOTO DENSHIKOGYO Co., Ltd. and a type described in JP-A 1-158433.

If the specific gravity of the processing solution is measured by the specific gravity sensor in the state of a working solution of the processing solution, the measurement may be made at any location, for example, in the processing tank, at a part of the circulation route of the processing solution or within separate section led-in from a part of the processing tank or circulation route.

The measured values of specific gravity and pH (i.e., data of specific gravity and pH measurements) are sent to a CPU which is connected to the processing apparatus described above, and may be subjected to arithmetic processing singly or together with parameters of the processing solution, such as temperature, content and processing volume, room temperature or humidity. Alternatively, the data sent to the CPU are subjected all the time or as needed to network processing which is connected to an external apparatus through a public circuit or the like. To maintain the concentration of the processing solution at an optimum level, it is preferable to vary a set-value of replenisher supply or water supply, with reference to data obtained in many minilabs.

Supplying a replenisher and water is conducted employing a conversion table (LUT) of amounts of the replenisher and water supplied to the tank and determined based on specific gravity and pH value. The conversion table is prepared in advance, taking into account the processing tank volume and information concerning the processing solution.

In the invention, processing solutions to be corrected by measuring the specific gravity value may be any processing solution relating to processing of conventional silver halide photographic materials, including a developing solution, bleaching solution, fixing solution, bleach-fixing solution, stop solution and/or stabilizing solution. Of these, the bleaching solution, fixing solution and bleach-fixing solution are specifically preferred in view of the fact that advantageous effects are most displayed when embodying the present invention with addition of a specific gravity value as a control value for the processing solution, in addition to basic physical values such as temperature and level position of the processing solution, which are measured and controlled in conventional automatic processing apparatuses for silver halide photographic materials.

Replenishers usable in the invention may be any of several forms, including, for example, a concentrated replenisher solution and solid processing compositions in the form of powder, granules and tablets.

The specific gravity or pH measurement may be carried out continuously or intermittently, and sampling for the specific gravity value measurement can be conducted at previously set timing or intervals, for example, for each unit of prescribed processing time or processing volume, or at the start or finish of processing. Timing for subjecting the obtained data to arithmetic processing, and a method and timing for providing instructions to the replenisher-supplying apparatus or the water-replenishing means to make corrections can be optimally designed. Correction may be made on the basis of the result obtained by accumulating plural data of specific gravity measurements and statistically treating the data according to the previously designed method.

Warning information may be displayed or noticed through sound or light according to measured specific gravity and pH values, regardless of the foregoing correction.

Next, the solid photographic processing composition used in the invention will be described. Photographic processing composition can be solidified by commonly known methods, for example in such a manner that a photographic processing composition in the form of a concentrated solution, fine powder or granules is kneaded together with a water-soluble binder (or a binder) and molded, or a water-soluble binder is sprayed onto the surface of a temporarily molded processing composition, as described in JP-A Nos. 4-29136, 4-85535, 4-85536, 4-85533, 4-85534 and 4-172341.

The tablet is prepared preferably by granulating powdery processing composition, followed by subjecting to the tableting process to form tablets. The thus prepared tablets are improved in solubility and storage stability than those prepared by simply mixing solid processing components, followed by subjecting to the tableting process, having advantages such as stable photographic performance.

Commonly known granulation methods can be employed to form granular or tablet-form processing composition, including rotary granulation, extrusion granulation, compression granulation, pulverizing granulation, fluidized-bed granulation, and spray-drying granulation. When thus obtained granules are mixed and compressed to form granular or tablet-form processing composition, the average particle size of the granules is preferably 100 to 800 $\mu$m, and more preferably 200 to 750 $\mu$m in terms of the fact that inhomogeneity of components, so-called segregation hardly occurs.

A particle size distribution that at least 60% of granular particles fall within the deviation of ±100 to 150 $\mu$m is preferable. Obtained granules are subjected to pressure compression, employing commonly known compressing machines, such as an oil-pressure pressing machine, single-shot type tableting machine, rotary tableting machine, and briquetting machine. Solid processing composition thus obtained by pressure compression can take any form and is preferably cylindrical form, so-called tablet-form in terms of productivity, handling and dust. In the granulation, it is preferred to subject respective ingredients such as an alkali, a reducing agent and a preservative to fractional granulation, whereby the above-described effects are markedly enhanced.

The tablet-form processing composition can be prepared by commonly known methods, as describe in JP-A Nos. 51-61837, 54-155038 and 52-88025 and British Patent No. 1,213,808. The granular processing composition can also prepared by commonly known methods, as described in JP-A Nos. 2-109042, 2-109043, 3-39735 and 3-39739. Further, powdery processing compositions can be prepared by commonly known methods, as described in JP-A No. 54-133332; British Patent No. 725,892 and 729,862; and German Patent No. 3,733,861.

The foregoing tablet-form solid processing composition preferably has a bulk density of 1.0 to 2.5 g/cm$^3$ in terms of solubility and desired effects of the invention. The bulk density of less than 1.0 g/cm$^3$ is not preferable in terms of solid strength, and the bulk density of more than 2.5 g/cm$^3$ is also not preferable in terms of solubility of the obtained solid. The bulk density of the granular or powdery processing composition is preferably 0.40 to 0.95 g/cm$^3$.

In solid processing compositions used in the invention, a part of ingredients of a solid processing composition may be solidified but all of the ingredients are preferably solidified. It is preferred that respective ingredients are separately formed and packaged together. It is also desirable that respective ingredients are separately packaged in the order of periodically and repeatedly charging.

Replenishers used in the invention include replenishers for all processing solutions used for silver halide photographic materials. Such processing solutions include, for example, commonly used black-and-white developer solution, stop solution, fixer solution, first developing solution for reversal development, infectious developer solution for lithographic use, color developer solution, bleach solution, bleach-fixer solution, stabilizer solution, hardening solution, amplifier solution, fogging solution and toning solution, but are not limited to these.

As a fixer used in the replenisher of the invention, commonly known compounds can be incorporated thereto, including a fixing agent, a chelating agent, a pH-buffering agent, hardening agent and a preservative, as described in JP-A 4-242246 (page 4) and JP-A 5-113632 (page 2–4). In addition thereto, commonly known fix-accelerating agents are usable.

As a bleach used in the replenisher of the invention, commonly known compounds can be used without specific limitation. Bleaching may be conducted concurrently with fixing (bleach-fixing) or may independently be conducted.

As a bleach-fixer used in the replenisher of the invention, commonly known compounds are usable without any specific limitation.

As a stabilizer or other processing solutions used in the replenisher of the invention, commonly known compounds are usable without any specific limitation.

In cases where color photographic materials are used in the invention are preferable used replenishers described in JP-A Nos. 5-224373 and 5-257247.

Automatic processors used in the invention include, for example, roller transport type or belt transport type processors and roller transport type processors are preferred. A reduced opening area at the top (or open top area) in a developing tank of the processor can restrain aerial oxidation and evaporation. In a bleach-fixing tank or a fixing tank, for example, an open top area coefficient of 20 cm$^2$/l, which is a ratio of aerial contact area (expressed in cm$^2$) to tank solution volume (expressed in liter), results in a reduced evaporation amount and reduced aerial oxidation, leading to improved process stability. The open top area coefficient is more preferably 1 to 15 cm$^2$/l, and still more preferably 2 to 12 cm$^2$/l.

One aspect of the invention is to comprise a control section which measures the specific gravity and pH of the processing solution in the working-conditioned processing tank and makes corrections of replenisher- and water-supplying amounts, and a replenisher-supplying means and a water-supplying means to supply the replenisher and water to the processing tank in accordance with instructions of a CPU.

As illustrated in FIG. 1, for example, the solution in constant temperature bath (13) linked to processing tank (11) through liquid pathway (12) is circulated from bottom opening (16) to the processing tank (11) passing through pathway (15) by operating circulation pump (14). Float SW (17), densimeter (18), temperature sensor (19), pH meter (20) and heater (21) are arranged in the constant temperature bath (13) to perform constant temperature control. The constant temperature bath (13) comprises replenisher-supplying means (22) to perform controlled supply of a replenisher such as solid processing composition and water-supplying means (24) to supply water (liquid corresponding to overflow of a subsequent bath) from the subsequent tank (not shown) by water-supplying pump (23). In the Figure, designation 25 is a filter provided on pathway (15). In this embodiment, over-flowed liquid from the processing bath (11) is re-supplied to a processing bath preceding the processing bath (11).

The replenisher-supplying means (22) is not limited to the foregoing and may have a supply from another constant temperature bath (not shown). The replenisher-supplying means (22) can employ commonly known techniques without specific limitation. As disclosed in JP-A No. 7-230155, for example, there may be employed an apparatus as described below:

an apparatus for replenishing a solid processing composition for use in a processing apparatus for photographic materials, the replenishing apparatus being installed over a processing tank containing a processing solution, provided in a photographic processing apparatus for processing an exposed photographic material and the solid processing composition held in a container being dropped in an optimum amount to the processing tank to perform replenishing to the processing tank, wherein the replenishing apparatus comprises a container having a plurality of solid processing compositions arranged in line and an opening for discharging the solid processing compositions; a means for loading the container, in which the container is inclined, thereby enabling movement of the solid processing compositions contained in the container to the discharge-opening employing an container being inclined; a means for so arranged to supply the solid processing composition to the processing tank by receiving a prescribed amount of the solid processing compositions through an opening of the solid processing compositions contained in the container and allowing the solid processing compositions to move to the position of the processing tank, and a sealing means, which tightly seals the opening when the solid processing composition is not being received by the means for supplying the solid processing composition.

Figure 2:
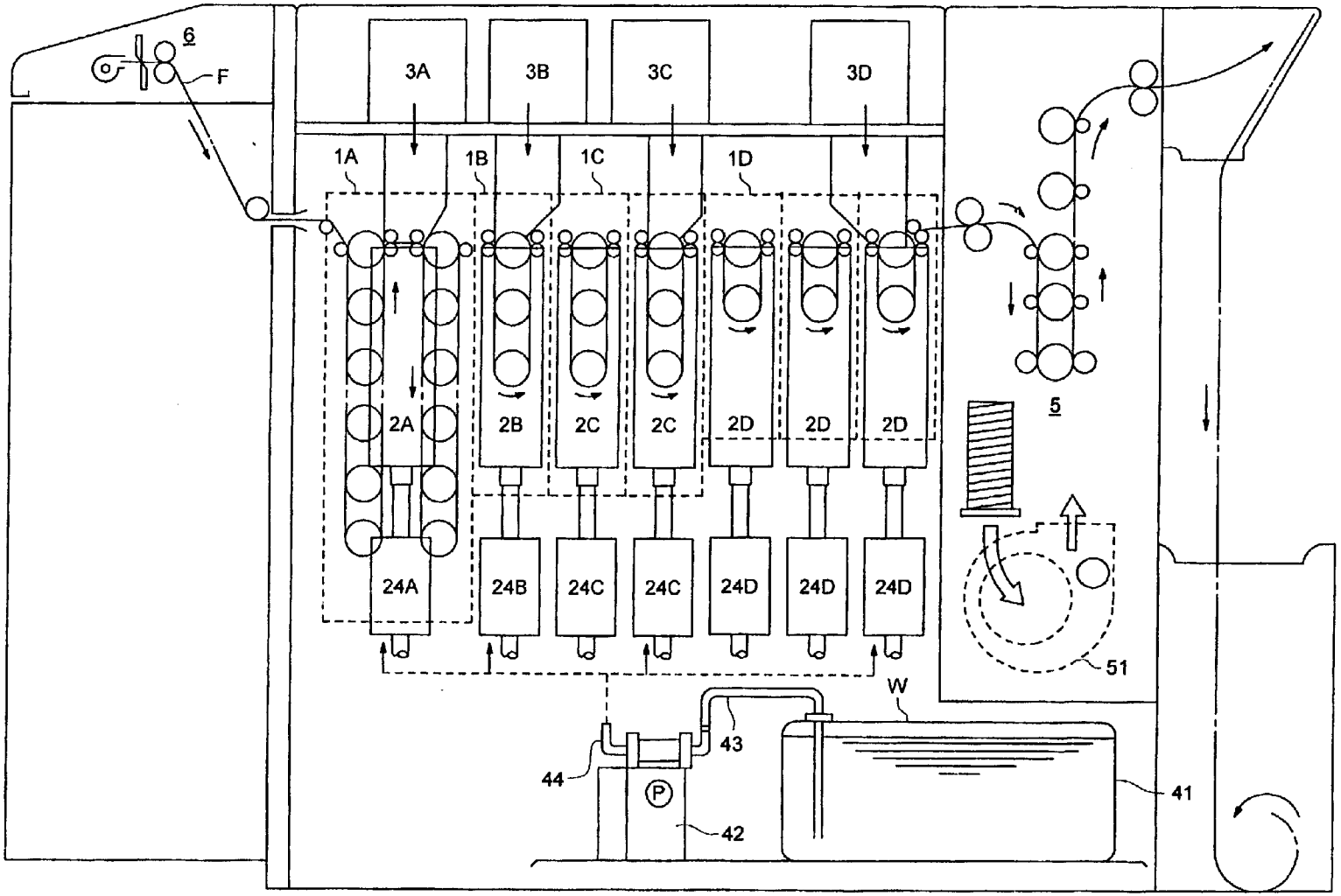
FIG. 2 shows a front view of a processor relating to the invention.

FIG. 2 is an overall frontal view of automatic processor (4) for color negative film, in which the processing method relating to the invention is applied. Processor (4) comprises substantially four processing baths, including color developing tank (1A), bleaching tank (1B), fixing tank (1C) and stabilizing tank (1D). Processing tanks 1A, 1B, 1C and 1D are connected to circulation tanks 2A, 2B, 2C and 2D, respectively and respective processing solutions are circulated by circulation pumps, 24A, 24B, 24C and 24D. Above circulation tanks 2A, 2B, 2C and 2D, means for supplying concentrated replenisher solution, 3A, 3B, 3C and 3D are respectively arranged, whereby concentrated replenisher solutions are controllably supplied in corresponding optimal amounts.

Shared replenishing water (W) in replenishing water tank (41) is supplied to each of the circulation tanks 2A, 2B, 2C and 2D, through bellows pump (42), feedwater pipe (43) and water supply pipe (44).

In FIG. 2, the single-dot chain line shows a film transport route. Film (F), which is taken out of a patrone loaded into a loading means in operation section (6), is processed in color developing tank (2A), bleaching tank (2B), fixing tank (2C) and stabilizing tank (2D), then dried by fan heater (51) in drying section (5).

Figure 3:
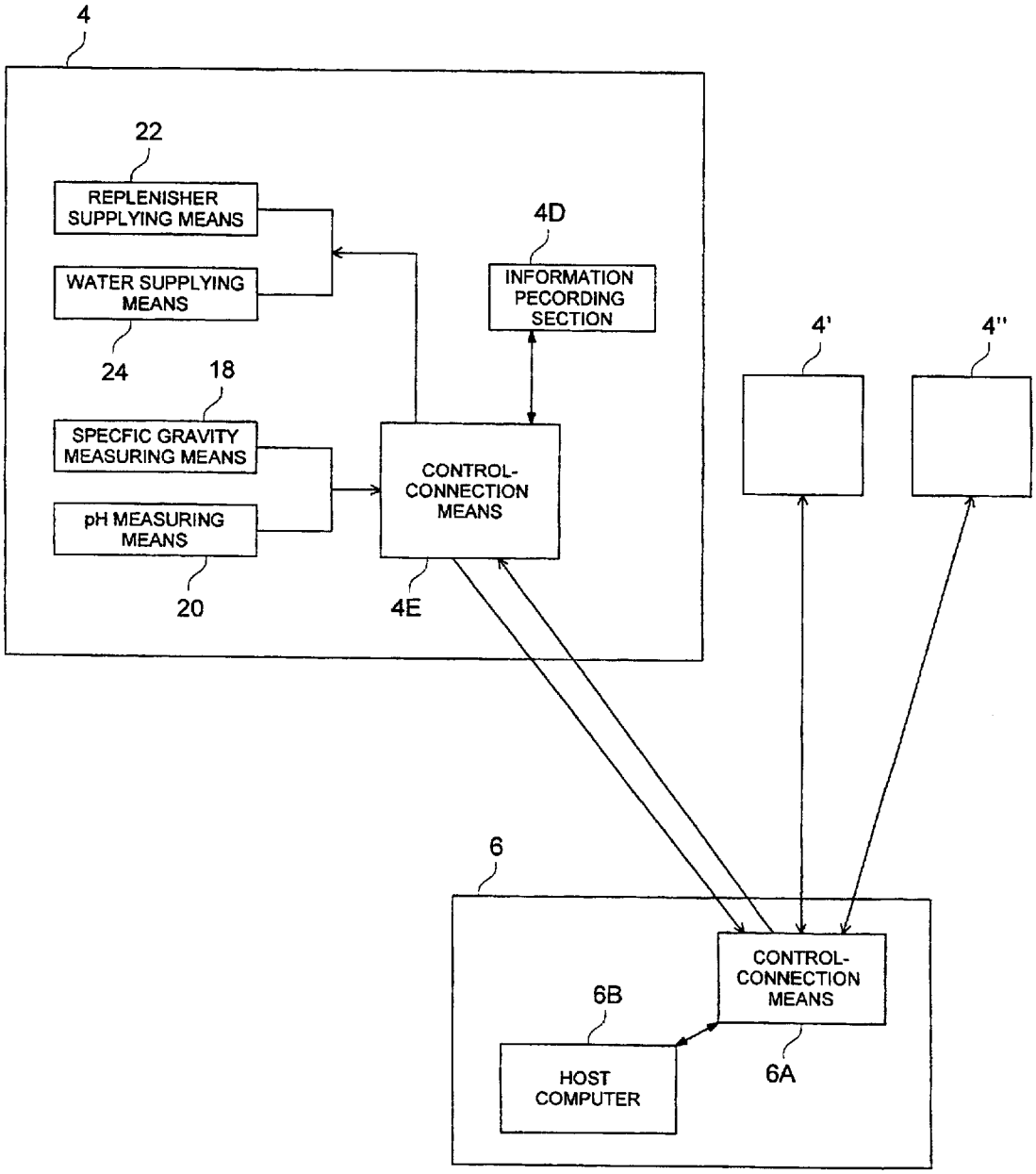
FIG. 3 is a schematic illustration of a remote control system relating to the invention.

FIG. 3 is a schematic illustration of remote control system (2) according to the invention. The remote control system comprises processing apparatuses 4, 4' and 4" intended for remote control and remote control system (6) connected to the processing apparatuses (4, 4' and 4") through a communication network and is capable of sending or receiving various informations and instructions. Processing apparatus (4) is provided with a measurement section comprising pH measuring means (20) and specific gravity measuring means (18), and a supplying means section comprising replenisher supplying means (22) and water supplying means (24). The supplying means section and measurement section are controlled by control-connection means (4E) and also provided with a means for communicating to the remote control system having a host computer. Processing apparatus (4) is also provided with information recording section (4D) to keep the processing volume per given time and measured values of specific gravity and pH. Processing apparatuses 4' and 4" are arranged similarly to processing apparatus (4).

Remote control system (6) is provided with control-connection section (6A), which not only controls the entire remote control system (6) but also is connected to processing apparatuses 4, 4' and 4" so as to be capable of transmitting and receiving data through a communication network, and host computer (6B) which records transmitted measurement data of specific gravity and pH, as well as processing volume information, and based thereon, conducts remote control corrections of replenisher and/or water supply amount, and optionally conducts remote diagnosis. In the host computer, standard values of specific gravity, pH and the like are stored, which can be changed as necessary. The thus changed standard value is transmitted to processing apparatus (4) through the communication network when called upon. The host computer has the function of accumulating information of specific gravity, pH and the like, inputted from plural processing apparatuses, and subjecting it to statistical treatment. Thus, a matrix of processing volume over a given period and specific gravity or pH data is prepared, whereby correction values can be calculated to adjust replenisher and water supplying amounts suited for each of the processing apparatuses.

Communication means (6A) comprises a computer to control the entire remote control system (6) and a means to connect it to various networks such as a WAN (Wide Area Network) or LAN (Local Area Network), for example, an ethernet card or a modem or router to be connected to the WAN and software used for connection to a network. The communication means receives transmitted data of specific gravity and pH, transmitting notice information to processing apparatuses (4, 4' and 4") and also transmitting instructions for automatic operation of processing apparatus (4) for remote diagnosis. Remote control means (6B) remotely controls each of processing apparatuses (4, 4' and 4") based on the transmitted specific and pH data, and is a software processing system, in which functions are accomplished by executing programs using a computer to control the entire remote control system (6). Of course, the functions may be accomplished by hardware. It is preferable that the remote control system only for transmitting and receiving data and the processing apparatus be connected by the foregoing communication means (6A).

In the invention, commonly known photographic materials can be used without any specific limitation. Thus, silver halide photographic materials, which are processed by the invention, include, for example, color film, color prints, reversal films, black-and-white film for general use, X-ray film, infrared film, film for lithographic use and microfilm, the invention is not limited to these and applicable to any silver halide photographic material.

EXAMPLES

The present invention will be further described based on examples and specifically based on an example, in which the water supplying amount of a feedwater pump deviated to a quantity more than the standard value. However, the invention is not limited to this example.

In fact, it was proved that the discharge of water-supply bellows pumps installed in an automatic photographic processing apparatus which were put into operation before at least one year was measured and exhibited fluctuations of −14% to +16%, based on a preset value. The following example is possibly caused in the market and is also an exemplary variation, in which performance variation of respective pumps cannot be expected or adjusted on a daily basis. It is needless to say that the present invention can also be effectuated for other uncontrollable or unexpected variations.

Example 1

Two film processors described earlier were arranged. In one of the processors, a specific gravity sensor, which was a functional portion taken out from a densimeter (DA-110, available from KYOTO DESNSHIKOGYO Co., Ltd.) was installed at the portion adjacent to a float switch (also denoted as Float SW) installed in the second tank of the fixing bath and connected so that output from the densimeter was processable in CPU, as shown in FIG. 1.

Using processing chemicals for color negative film (CNK-4-JI, available from Konica Corp.), 24 rolls of each of exposed Konica Color CENTURIA 400 (24 exposures), exposed Fuji Color SUPERA 400 (24 exposures) and exposed Kodak GOLD 400 (24 exposure) were processed for a day (and processing for a week corresponded to one round of processing solution replacement).

In this case, the discharge of a bellows pump used for water supply to the fixing tank of the two processors was set at a value greater by 15% than the preset value and after that, the discharge was checked twice a week so that this value was maintained over the period of the foregoing experiment. As a fixing solution at the start of the experiment was used a working solution having performance falling within the control range, whose specific gravity was 1.130.

The water-replenishing rate for evaporation and replenisher-supplying and water-supplying rates for processing volume were each set at a standard value. Further, the processor installed with a densimeter, as described earlier was adjusted so that the rate of the replenisher or water supplied to the processing tank were each corrected, based on an output value (S) of the specific gravity sensor in accordance with the following equations:

when specific gravity value (S) is more than 1.130, replenisher-supplying rate, $K=K_0$ and water-supplying rate, $W=K_0\times(S-1)/0.130$; (1)

when specific gravity value (S) is not more than 1.130, replenisher-supplying rate, $K=K_0\times(S-1)/0.130$, and water-supplying rate, $W=W_0$ (2)

where $K_0$ is a standard value of fixing-replenisher supplying rate (i.e., supplying amount per unit area, expressed in $g/m^2$) and $W_0$ is a standard value of water supplying rate (water supplying amount per unit area, expressed in $ml/m^2$). The specific gravity measurement was conducted once a day to determine the corrected value. The fixing replenisher and water were each supplied for each 0.2 $m^2$ in processing amount.

After 2 weeks elapsed, the specific gravity of the second tank of the fixing bath was 1.125; on the contrary, in the case of the specific gravity sensor not having been installed, the specific gravity was 1.109, and fixing stain and uneven density were observed in a portion of the processed film. In the case of the specific gravity sensor being installed and the foregoing water supply being adjusted, no fixing stain was observed.

Example 2

Processing was conducted similarly to Example 1, provided that the processor installed with a densimeter was adjusted so that the rate of the replenisher or water supplied to the color developing tank were each corrected, based on an output value (S) of the specific sensor in accordance with the following equations:

replenisher supplying rate, $K=K_0\times10^{(10-P)}$, and water supplying rate, $W=W_0$.

After 2 weeks elapsed, the pH of the color developing solution was 10.02; in the case of the specific gravity sensor not having been installed, the pH was 9.9 and the maximum cyan density of the processed film was lower than the intended value, producing problems in print quality.

Example 3

The processor used in Example 1 further had a built-in modem and was capable, when dialed, of being connected through telephone network to the host computer. The storage section of the host computer contained an information recording section, in which the history of the specific gravity and pH values in the processor was recorded and the processing amount for every day was also recorded. The processor was set to be connected to the host computer at the end of daily work, wherein the amounts of the replenisher and water to be supplied were calculated according to the following equations and preset values of the replenisher and water to be supplied were each corrected during the connection:

when $S>S_a$, replenisher-supplying rate, $K=K_0$, water-supplying rate, $W=W_0+[(S-S_a)/(S_a-1)]\times W_0/R$;

when $S\leqq S_a$, replenisher-supplying rate, $K=K_0+[(S-S_a)/(S_a-1)]\times K_0/R$, water-supplying rate, $W=W_0$ where S is a measured value of specific gravity, $S_a$ is an intended value of specific gravity and R is the number of rolls of processed film, and $K_0$ and $W_0$ were the same as defined in Example 1.

After an elapse of two weeks, the specific gravity of the second tank of the fixing bath was 1.128, being close to the intended value and producing no problems in photographic performance. On the contrary, the processor, which was not connected to the host computer, exhibited a specific gravity of 1.109, producing problems such as fixing marks due to fixing troubles, which were observed in some processed film.

What is claimed is:

1. A photographic processor for a silver halide photographic material, comprising at least one processing tank containing a processing solution, a supplier to supply a replenisher to the processing tank in proportion to a processing amount of the for correcting a supplying rate of the replenisher or water to the processing tank on the basis of measurement data of a specific gravity of a pH of the processing solution, wherein the processing tank has an open top area coefficient of 1 to 15 $cm^2/l$, and wherein the processing tank is a fixing tank or a bleach-fixing tank.

2. The processor of claim 1, wherein said correction means corrects the supplying rate of the replenisher or water further using information of a processing volume of the photographic material per prescribed period of time.

3. The processor of claim 1, wherein said correction means corrects the supplying rate of the replenisher or water on the basis of the measurement data plural times over a period of from start to finish of running the processor.

4. The processor of claim 1, wherein said correction means corrects the supplying rate of the replenisher or water on the basis of the measurement data at the start or at the finish of running the processor.

5. A remote control system for controlling a photographic processor for a silver halide photographic material, wherein the photographic processor is connected to a host computer through a communication means so that measurement data of a specific gravity or pH of a processing solution contained in at least one processing tank of the processor is transmitted to the host computer, the transmitted data is subjected to calculation to obtain a calculation result, the calculation result is transmitted to the photographic processor through the communication means to control supply of a replenisher or water to the processing tank; the remote control system comprising a means for measuring a specific gravity or a pH of the processing solution, and a control means for controlling a supplying rate of the replenisher or water to the processing tank, wherein the processing tank has an open top area coefficient of 1 to 15 $cm^2/l$, and wherein the processing tank is a fixing tank or a bleach-fixing tank.

6. The control system of claim 5, wherein the control means controls the supplying rate of the replenisher or water to the processing tank further using information of a processing volume of the photographic material per prescribed period of time.

7. The control system of claim 5, wherein the communication means is connected to the host computer at the time when the measurement data is transmitted to the host computer but is not connected to the host computer at the time when the measurement data is not transmitted to the host computer.

8. The control system of claim 5, wherein the measurement data transmitted to the host computer is stored in identification code in the host computer.

9. The processor of claim 1, wherein the replenisher is a solid processing composition.

10. A photographic processor for a silver halide photographic material, comprising at least one processing tank to contain a processing solution, a first device to supply a replenisher to the processing tank in proportion to a processing amount of the photographic material, a second device to supply water to the processing tank, and a third device to correct a supplying rate of the replenisher or water to the processing tank on the basis of measurement data of a specific gravity or a pH of the processing solution, wherein the processing tank has an open top area coefficient of 1 to 15 $cm^2/l$.

11. The processor of claim 10, wherein the third device corrects the supplying rate of the replenisher or water further using information of a processing volume of the photographic material per prescribed period of time.

12. The processor of claim 10, wherein the third device corrects the supplying rate of the replenisher or water on the basis of the measurement data plural times over a period of from start to finish of running the processor.

13. The processor of claim 10, wherein the third device corrects the supplying rate of the replenisher or water on the basis of measurement data at the start or at the finish of running the processor.

14. The processor of claim 10, wherein the replenisher is a solid processing composition.

15. A remote control system comprising a photographic processor for a silver halide photographic material, comprising a processing tank to contain a processing solution, a first device to measure a specific gravity or a pH of the processing solution, a second device to control a supplying rate of the replenisher or water to the processing tank, and a host computer connected to the photographic processor through a communication device so that measurement data of the specific gravity or pH of the processing solution is transmitted to the host computer, the measurement data transmitted is subjected to calculation to obtain a calculation result, and the calculation result is transmitted to the photographic processor through the communication device to control supply of a replenisher or water to the processing tank, wherein the processing tank has an open top area coefficient of 1 to 15 $cm^2/l$, and wherein the processing tank is a fixing tank or a bleach-fixing tank.

16. The remote control system of claim 15, wherein the second device controls the supplying rate of the replenisher or water to the processing tank further using information of a processing volume of the photographic material per prescribed period of time.

17. The remote control system of claim 15, wherein the communication device is connected to the host computer at the time when the measurement data is transmitted to the host computer but is not connected to the host computer at the time when the measurement data is not transmitted to the host computer.

18. The remote control system of claim 15, wherein the measurement data transmitted to the host computer is stored in identification code in the host computer.

* * * * *